United States Patent [19]

Vader et al.

[11] Patent Number: 5,045,110

[45] Date of Patent: Sep. 3, 1991

[54] ALUMINIUM-STRONTIUM MASTER ALLOY

[75] Inventors: Mattheus Vader; Jan Noordegraaf; Edward H. Klein Nagelvoort; Jan P. Mulder, all of Delfzijl, Netherlands

[73] Assignee: Shell Research Limited, England

[21] Appl. No.: 525,704

[22] Filed: May 21, 1990

[30] Foreign Application Priority Data

May 19, 1989 [EP] European Pat. Off. ..... 89201287.3

[51] Int. Cl.[5] ..... B22F 9/08; C22C 1/03

[52] U.S. Cl. ..... 75/338; 420/549

[58] Field of Search ..... 75/338; 420/549

[56] References Cited

U.S. PATENT DOCUMENTS

| | | | |
|---|---|---|---|
| 3,567,429 | 3/1971 | Dunkel | 75/10 |
| 4,009,026 | 2/1977 | Rasmessen | 75/338 |
| 4,108,646 | 8/1978 | Gennone et al. | 420/549 |
| 4,394,348 | 7/1983 | Hardy et al. | 420/549 |
| 4,576,791 | 3/1986 | Thistlethwaite | 420/552 |
| 4,762,553 | 8/1988 | Savage et al. | 75/338 |

FOREIGN PATENT DOCUMENTS

| | | | |
|---|---|---|---|
| 0254698 | 6/1987 | European Pat. Off. . | |
| 0170503 | 8/1986 | Japan | 75/338 |

OTHER PUBLICATIONS

Metals Handbook, 9th edition, vol. 7, "Powder Metallurgy", pp. 25-51, 125-130, 293.

*Primary Examiner*—Upendra Roy

[57] ABSTRACT

A process is described for the preparation of an aluminium-strontium master alloy suitable for use as structure refiner during the solidification of molten aluminium-silicon alloys, comprising atomizing a molten alloy containing 3 to 30% by weight of strontium, the balance being aluminium, quick cooling of the atomized droplets to obtain solid particles and consolidation of the obtained solid particles.

18 Claims, 3 Drawing Sheets

BEST AVAILABLE COPY
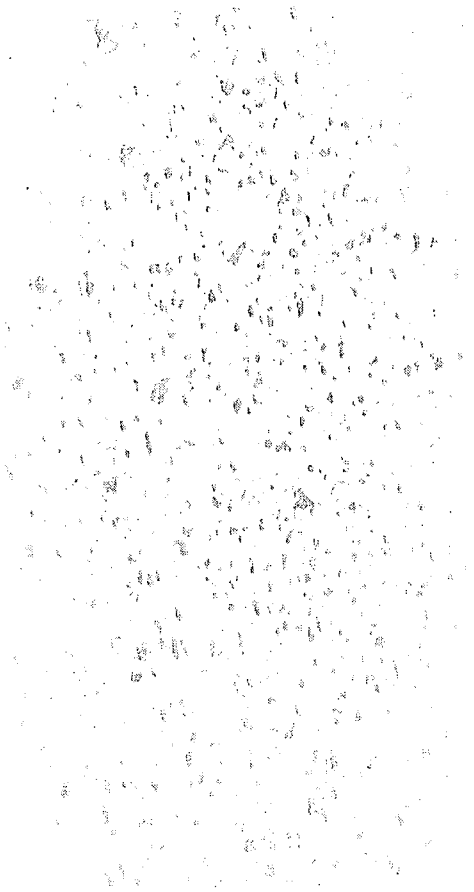
FIG. 1 (5 COX)

ALUMINIUM-STRONTIUM MASTER ALLOY

BACKGROUND OF THE INVENTION

The invention relates to a process for the reparation of aluminium-strontium master alloys, to master alloys thus obtained and to the use of these master alloys as structure refiner during the solidification of molten aluminium-silicon alloys.

Aluminium-silicon alloys are widely used for the production of cast products as aircraft parts, internal combustion engine parts as pistons and valve sleeves etc. To obtain cast products of a suitable (high) quality it is essential to add a structure refiner to the molten alloy to induce the formation of relatively small silicon crystals during the solidification. The thus obtained cast products show increased mechanical properties, ductility and strength when compared with the case that a structure refiner is not used.

In this specification the term structure refiner is used for a compound or composition which, after addition and mixing and/or dissolution in a molten metal or alloy, either as such or as a newly formed compound, induces during solidification the formation of smaller crystals than would have been the case when the structure refiner would not have been used.

Heretofore, sodium has been used as a structure refiner for the aforesaid aluminium-silicon alloys, especially eutectic or hypo-eutectic aluminium-silicon alloys, i.e. alloys containing up to about 12% by weight of silicium. More recently strontium has been used instead of sodium because it gives a better structure refining effect than sodium, together with a more economical (limited burnoff loss compared with sodium) and less dangerous process.

During the solidification of hypo-eutectic aluminium-silicon alloys first primary aluminium crystals are formed until the eutectic composition is obtained, whereafter simultaneously aluminium crystals together with silicon crystals are formed. The silicon crystals show an acicular form and are fairly large when no structure refiner is used. When a structure refiner is used these silicon crystals are relatively small and show a fibrous character, resulting in the above described improved properties.

It is presumed that upon dissolving an aluminium-strontium master alloy small particles of aluminium-strontium intermetallics ($Al_4Sr$) are liberated which at their turn dissolve and thus provide strontium in solution, whereafter the strontium during the solidification increases the number of silicon crystals substantially, resulting in a large number of small crystals instead of a small number of large crystals.

Strontium may be added to the aluminium-silicon melt as a pure metal or as a master alloy. As the addition of metallic strontium is quite troublesome, the strontium is predominantly added in the form of master alloys. In this respect reference is made to U.S. Pat. No. 4,009,026, describing a strontium-silicon-aluminium master alloy, and U.S. Pat. No. 3,567,429, describing a strontium-silicon master alloy. The processes for the preparation of the master alloys described in the above mentioned patents, however, are quite laborious and expensive. Further, the thus obtained master alloys have contact times of between five and thirty minutes before the refining effect is fully obtained. These alloys have a microstructure in which especially the $AlSr_4$ particles are coarse. This results in the long contact times and is furthermore detrimental to the ductility of the product. Attempts have therefore been made to prepare quick dissolving aluminium-strontium master alloys to allow in-line (addition in the launder) feeding and which have sufficient ductility to enable coiling and decoiling.

The dissolution velocity of conventionally cast aluminium-strontium master alloys, however, is low, especially when the amount of strontium in the alloy is more than 5% by weight. Furthermore, these alloys are usually very brittle, which makes it impossible to use conventional coil feeders. See for instance U.S. Pat. No. 4,576,791. Especially the low dissolving velocity is a clear disadvantage as the master alloys are preferably added just immediately before casting in view of the high oxidation velocity of strontium. This helds especially in the case of launder feeders.

SUMMARY OF THE PRESENT INVENTION

It has now been found that very suitable aluminium-strontium master alloys containing a relatively large amount of strontium may be obtained by atomisation of molten alloy, followed by consolidation of the obtained solid particles for instance by extrusion. The master alloys thus obtained dissolve very rapidly in liquid aluminium and are very suitable for use as effective structure refiners of eutectic and hypo-eutectic aluminium-silicon alloys. Due to their high ductility (elongation >5–10%) in-line feeding using conventional coil feeders is possible.

The present invention therefore relates to a process for the preparation of an aluminium-strontium master alloy suitable for use as structure refiner during the solidification of molten aluminium-silicon alloys, comprising atomizing a molten alloy containing 3 to 30% by weight of strontium, the balance being aluminium, quick cooling of the atomized droplets to obtain solid particles and consolidation of the obtained solid particles.

BRIEF DESCRIPTION OF THE DRAWINGS

FIG. 1 is a photomicrograph depicting the microstructure of the alloy of Example 1.

FIG. 2*a* and 2*b* are photomicrographs depicting the treated and untreated cast alloy of Example 6.

FIG. 3 is a graph depicting the yield of strontium addition in relation to the dissolution time.

DETAILED DESCRIPTION OF THE INVENTION

The maser alloys obtained by the above described process are very efficient structure refiners for aluminium-silicon alloys, especially eutectic and hypo-eutectic alloys. The amount of strontium taken up in the casting alloy is extremely high, and is usually between 95 and 100%. Under normal circumstances there is no gas pick up during the addition, while also dross formation is very small or even absent. The master alloys are effective for low as well as high cooling rates in the aluminium-silicon alloys in which they should be active. The dissolution velocity is high (usually less than two minutes). The temperature loss is relatively low when compared with conventionally cast aluminium-strontium master alloys which contain less strontium. As the alloy obtained is very ductile, the alloy may be produced in the form of wire or coils, thus making it possible to feed the alloy using conventional coil feeders.

The amount of strontium is preferably between 5 and 25% by weight, more preferably between 7.5 and 15% by weight. Further, minor amounts of one or more other elements may be present in the master alloy, for instance iron and silicon. Also trace amounts of the usual impurities may be present.

In a preferred embodiment the master alloy also contains titanium and/or boron as these elements show a very good structure refining effect on aluminium crystals, thus resulting in aluminium-silicon casting alloys having further improved properties. The amount of titanium is suitably between 0.5 and 5% by weight, the amount of boron is suitably between 0.02 and 2% by weight. Preferably the amount of titanium is between 1 and 3% by weight and the amount of boron between 0.05 and 1% by weight.

The atomisation of the molten alloy may be carried out by methods known in the art. As a general rule the atomisation process may be described as any comminution process of liquid metal streams in which a molten metal stream is disintegrated into small droplets, usually spherical, oval, elliptical, rounded cylindrical etc. droplets, particles or ligaments. The breakup of a liquid stream brought about by the impingement of high-pressure jets of gas is usually called "gas atomisation". The use of centrifugal force to break up a liquid stream is known as "centrifugal atomisation:. Atomisation in vacuum is known as "vacuum atomisation". The use of ultrasonic energy to effect break up is referred to as "ultrasonic atomisation". The droplets formed in the atomisation process cool down and solidify during their flight, and are collected as solid particles. For an extensive review about atomisation processes and powder generation reference is made to the Metals Handbook, 9th edition, Volume 7, Powder Metallurgy, pages 25 to 51 and the references cited therein. For a review concerning the atomisation especially of aluminium, reference is made to the same reference, pages 125 to 130 and the references cited therein.

A very suitable atomisation process which can be used in the process of the present invention is gas atomisation. A stream of liquid alloy passes a nozzle where it is atomised into small droplets which droplets are cooled during their following flight through the so called atomisation chamber. A suitable atomisation gas is air. Also nitrogen and argon may be used. A typical metal flow rate varies between 5 and 60 kg/min, especially between 10 and 45 kg/min. A typical gas flow rate varies between 2 and 12 $m^3$/min, especially between 4 and 8 $m^3$/min. The gas pressure is suitably chosen between 500 and 5000 kPa. The temperature of the molten alloy is suitably chosen from the melting point of the alloy to a temperature 50° to 250° C. above the melting point, especially 100° to 150° C. The atomised droplets are cooled and solidified during their flight through the atomisation chamber. This chamber may be purged with an inert gas. The powder may be collected as dry particles or cooled with water at the bottom of the chamber. In the dry collection method the atomisation chamber is usually fairly large, for instance at least 6 to 10 meters, in order to ensure complete solidification of the powder particles before they reach the bottom of the collection chamber. The atomisation process may be carried out vertically (upwardly or downwardly) or horizontal.

The cooling rate in the above described gas atomisation processes is suitably between 50° and $10^4$° C./s, preferably between 100° and $10^4$° C./s, which is much faster than cooling rates obtained in conventional casting processes (0.001°–10° C./s), e.g. in the case of direct chill casting.

A preferred atomisation process for the process of the present invention is centrifugal atomisation. In this process a stream of molten metal is impinged on a rapidly spinning disk or cup in the top of an atomisation chamber. The liquid metal is mechanically atomised and thrown off the disk or cup. The rotating disk or cup may be equipped with vanes or holes through which the molten alloy exits. The rotating body may be made from e.g. a metal or a ceramic material. A typical metal flow rate varies between 4 and 60 kg/min, especially between 8 and 45 kg/min. The temperature of the molten alloy is suitably chosen from the melting point of the alloy to a temperature 50° to 250° C. above the melting point, especially 100° to 150° C. The atomised droplets are cooled and solidified during their flight through the atomisation chamber. The height of the atomisation chamber is usually fairly large, for instance 6 to 10 meters, in order to ensure complete solidification of the powder particles before they reach the bottom. The diameter of the obtained particles will usually be between 50 and 5000 micrometer, and is preferably between 100 and 4000 micrometer. The cooling rate in this process is suitably between 50° and $10^4$° C./s, preferably between $10^2$° and $10^4$° C./s.

The consolidation of the obtained powders may be carried out using conventional, mechanical techniques. In this respect reference is made to the Metals Handbook, 9th edition, especially Volume 7, Consolidation of Metal Powders, page 293 ff. During the consolidation process a coherent metal structure is obtained. Net shaped articles may be produced, but usually billets, rod, strip, wire and tubing products are made. A preferred consolidation technique is extrusion in which the metal particles are forced through an orifice or die of the appropriate shape. Cold extrusion is usually suitable, although hot extrusion also may be used.

The amount of master alloy to be added to the cast alloy is usually chosen in such a way that the desired degree of structure refining is obtained. The actual amount may be determined in each case by the make up of the particular aluminium-silicon alloy to be treated, the cooling rate and the degree of structure refinement desired. Generally the master alloy is added to the molten aluminium-silicon alloy in an amount which introduces at least 0.002% (w/w) strontium in the alloy, and preferably between 0.01 and 0.10% (w/w), more preferably between 0.015 and 0.05% (w/w).

The use of the before mentioned master alloys is especially suitable in the case of eutectic and hypo eutectic aluminium- silicon alloys. The amount of silicon in such alloys varies between 3 and 12%, especially between 6 and 11%. Further, some minor amounts of other elements may be present in the alloy, for instance iron (up to 3%), copper (up to 6%), manganese (up to 1%), magnesium (up to 2%), nickel (up to 3%), chromium (up to 1%), zinc (up to 3%) and tin (up to 1%). Also trace amounts of the usual impurities may be present.

The invention further relates to the master alloys which are obtained by the above described processes and to the use of these master alloys in the structure refining during the solidification of aluminium-silicon cast alloys. The invention also relates to a process for the structure refining during the solidification of aluminium-silicon alloys, especially eutectic and hypo eutectic aluminium-silicon alloys, and to aluminium-silicon alloys thus prepared, as well as to products made from these alloys.

EXAMPLES

EXAMPLE 1

A molten alloy containing 10% by weight of strontium, balance aluminium (99.7%) in an induction furnace at a temperature of 890° C. was poured at a velocity of 540 kg/h in the top of an atomisation chamber having a height of 8 m. Small solid particles were collected from the bottom of the atomisation chamber and fed into a cold extrusion press. An A110Sr rod with a nominal diameter of 10 mm is obtained which is used for structure refining experiments. The rod may be coiled up or used as such after cutting. The microstructure is shown in FIG. 1.

EXAMPLE 2

Experiment 1 was repeated using a molten alloy containing 8% of strontium, 1% of titanium, 0.2% of boron, balance aluminium (99.7%) at a temperature of 950° C. A ductile rod was obtained after extrusion.

EXAMPLE 3

Experiment 1 was repeated using a molten alloy containing 10% of strontium, 1% of titanium, 0.2% of boron, balance aluminium (99.7%) at a temperature of 950° C. A ductile rod was obtained after extrusion.

EXAMPLE 4

Experiment 1 was repeated using a molten alloy containing 3.5% of strontium, 1% of titanium, 0.2% of boron, balance aluminium (99.7%) at a temperature of 875° C. A ductile rod was obtained after extrusion.

EXAMPLE 5

Experiment 1 was repeated using an aluminium-strontium alloy containing 15% by weight of strontium. A ductile rod was obtained after extrusion. The casting temperature was 990° C.

EXAMPLE 6

The master alloys produced in experiments 1 to 5 were used for grain refining of an aluminium-7%silicium-0.4%magnesium alloy. The amount of strontium added was 0.03% by weight of the ultimate alloy. Cooling rates of the cast alloy was 8° C./s. Upon microscopical inspection of the treated and untreated casted alloys it appeared that a clear structure refining had taken place. In FIGS. 2*a* and 2*b* the structures of treated and untreated alloy are shown (enlargement 500×) for which the master alloy prepared in Example 1 at a cooling rate of 500° C./s was used.

EXAMPLE 7

The master alloy prepared in Example 1 was tested in the grain refining of aluminium-12%silicon and compared with conventional casted and rolled Al-3.5%Sr rod. The dissolution rate of Al-10%Sr rod is clearly faster (about two times) to obtain the same amount of strontium in the cast alloy from a more concentrated, and thus smaller, amount of master alloy. The dissolution times of aluminium-strontium ingots is considerable longer. The results are graphically shown in FIG. 3, showing the yield of strontium addition (%) in relation to the dissolution time (m). In this figure line 1 represents the dissolution velocity of Al-10%Sr rod (Example 1), line 2 represents the dissolution velocity of conventional cast and rolled Al-3.5Sr rod, line 3 represents the dissolution velocity of an Al-5%Sr ingot and line 4 represents the dissolution velocity of an Al-10%Sr-14%Si ingot.

We claim:

1. Process for the preparation of an aluminum-strontium master alloy suitable for use as structure refiner during the solidification of molten aluminum-silicon alloys, comprising atomizing a molten alloy containing 3 to 30% by weight of strontium to form atomized droplets of same, the balance of said molten alloy being aluminum, quick cooling the atomized droplets of said alloy at a cooling rate of between $10^{2°}$ and $10^{5°}$ C./s to obtain solid particles, and consolidating the thus-obtained solid particles.

2. Process according to claim 1 in which the aluminum-strontium master alloy contains 5 to 25% by weight of strontium.

3. Process according to claim 1, wherein the aluminum-strontium master alloy contains in addition to aluminum and strontium 1 to 10% by weight of titanium and/or 0.02 to 4% by weight of boron.

4. Process according to claim 1, wherein the atomisation process is a gas atomisation process.

5. Process according to claim 1, wherein the atomisation process is a vacuum atomisation process.

6. Process according to claim 1, wherein the atomisation process is an ultrasonic atomisation process.

7. Process according to claim 1, wherein the atomisation process is a centrifugal atomisation process.

8. Process according to claim 1, wherein the cooling rate is between $10^{2°}$ and $10^{4°}$ C./s.

9. Process according to claim 1, wherein the consolidation process is an extrusion process.

10. Aluminum-strontium master alloy prepared according to the process of claim 1.

11. Process for the structure refining during the solidification of molten aluminum-silicon alloys, comprising combining the aluminum-strontium master alloy prepared according to claim 1 with said molten aluminum-silicon alloy.

12. Process according to claim 1, wherein said solid particles have a diameter of between 50 and 5000 micrometer.

13. Process according to claim 2 in which the aluminum-strontium master alloy contains 7.5 to 15% by weight of strontium.

14. Process according to claim 3, wherein the aluminum-strontium master alloy contains in addition 2 to 5% by weight of titanium and/or 0.05 to 2% by weight of boron.

15. Process according to claim 7, wherein the centrifugal atomisation process is carried out using a rapidly rotating disk or cup.

16. Process according to claim 9 wherein the extrusion process is a cold extrusion process.

17. Process according to claim 12, wherein said solid particles have a diameter of between 100 and 4000 micrometer.

18. Process according to claim 15, wherein the rapidly rotating disk or cup is provided with vanes or holes.

* * * * *